US011220936B1

(12) United States Patent
Dudar

(10) Patent No.: US 11,220,936 B1
(45) Date of Patent: Jan. 11, 2022

(54) METHODS AND SYSTEMS FOR DIAGNOSING A CLOGGED CRANKCASE AND FOR PERFORMING A CRANKCASE CLEAN OUT

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/183,248

(22) Filed: Feb. 23, 2021

(51) Int. Cl.

| | |
|---|---|
| ***F02B 77/08*** | (2006.01) |
| ***F01M 1/20*** | (2006.01) |
| ***F01M 13/02*** | (2006.01) |
| ***F01M 13/04*** | (2006.01) |

(52) U.S. Cl.
CPC ..... *F01M 1/20* (2013.01); *F01M 13/028* (2013.01); *F01M 13/04* (2013.01); *F01M 2250/60* (2013.01)

(58) Field of Classification Search
CPC ..... F01M 13/04; F01M 2013/0433; F01M 13/00; F01M 2013/0083; F01M 2250/00; F01M 2013/027; B01D 45/08; F02B 77/08
See application file for complete search history.

(56) References Cited

U.S. PATENT DOCUMENTS

| | | | | |
|---|---|---|---|---|
| 9,316,131 | B2 | 4/2016 | Rollinger et al. | |
| 9,909,470 | B2 | 3/2018 | Christian et al. | |
| 10,767,590 | B1 | 9/2020 | Jentz et al. | |
| 2012/0074069 | A1* | 3/2012 | Ripley | B01D 35/1435 210/741 |
| 2018/0350169 | A1* | 12/2018 | Ahlborn | F01M 13/04 |

* cited by examiner

*Primary Examiner* — George C Jin
*Assistant Examiner* — Teuta B Holbrook
(74) *Attorney, Agent, or Firm* — Geoffrey Brumbaugh; McCoy Russell LLP

(57) ABSTRACT

Methods and systems are provided for diagnosing a clogged crankcase and performing a crankcase clean out. In one example, a method of operating an engine system including an engine includes measuring a crankcase pressure, and in response to the crankcase pressure increasing above a threshold pressure, determining a position of a clogged oil separator in a crankcase, and directing fluid to flow through the clogged oil separator and into the crankcase until a flow rate of the fluid through the clogged oil separator and into the crankcase increases above a threshold flow rate.

20 Claims, 8 Drawing Sheets

METHODS AND SYSTEMS FOR DIAGNOSING A CLOGGED CRANKCASE AND FOR PERFORMING A CRANKCASE CLEAN OUT

FIELD

The present description relates generally to methods and systems for diagnosing a clogged crankcase and for clean out a crankcase.

BACKGROUND/SUMMARY

The positive crankcase ventilation (PCV) system aids in relieving crankcase pressure into the intake manifold where oil vapor can be combusted inside the engine cylinders. A crankcase pressure (CKCP) sensor is positioned within the PCV system to diagnose leaks as well as blockages in the PCV system. A low CKCP may indicate a leak in the PCV system, for example, due to a PCV hose disconnect, which can increase vehicle emissions. Conversely, a high CKCP may indicate presence of a blockage in the PCV system that is restricting the flow of crankcase gases. A common source of PCV system blockages includes oil sludge clogging the crankcase oil separators. High CKCP can lead to higher internal engine pressures, which increases a risk of engine seal and/or engine gasket damage and engine oil leaks, and can lead to engine damage and engine degradation, resulting in costly repairs.

PCV system blockages, including clogged crankcase oil separators, are typically addressed by performing maintenance service of a PCV system at a vehicle dealership or garage. However, performing additional service to remove blockages in the PCV system can increase vehicle down time and reduce customer satisfaction. Furthermore, prior to service, operation of a vehicle with increased CKCP and higher internal engine pressure can adversely impact engine operation and reduce vehicle performance.

In one example, the issues described above may be at least partially addressed by a method of operating an engine system, comprising, measuring a crankcase pressure, and in response to the crankcase pressure increasing above a threshold pressure, determining a position of a clogged oil separator in the crankcase, and flowing fluid through the clogged oil separator and into the crankcase until a flow rate of the fluid through the clogged oil separator and into the crankcase increases above a threshold flow rate. In this way, the technical effect of automatically diagnosing and self-cleaning a clogged PCV system onboard a vehicle is provided. Furthermore, by mitigating blockages in the PCV system, a risk of vehicle operation with increased internal engine pressures can be reduced, thereby increasing vehicle performance. Further still, maintenance service on the vehicle can be reduced, thereby increasing customer satisfaction and reducing vehicle downtime.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
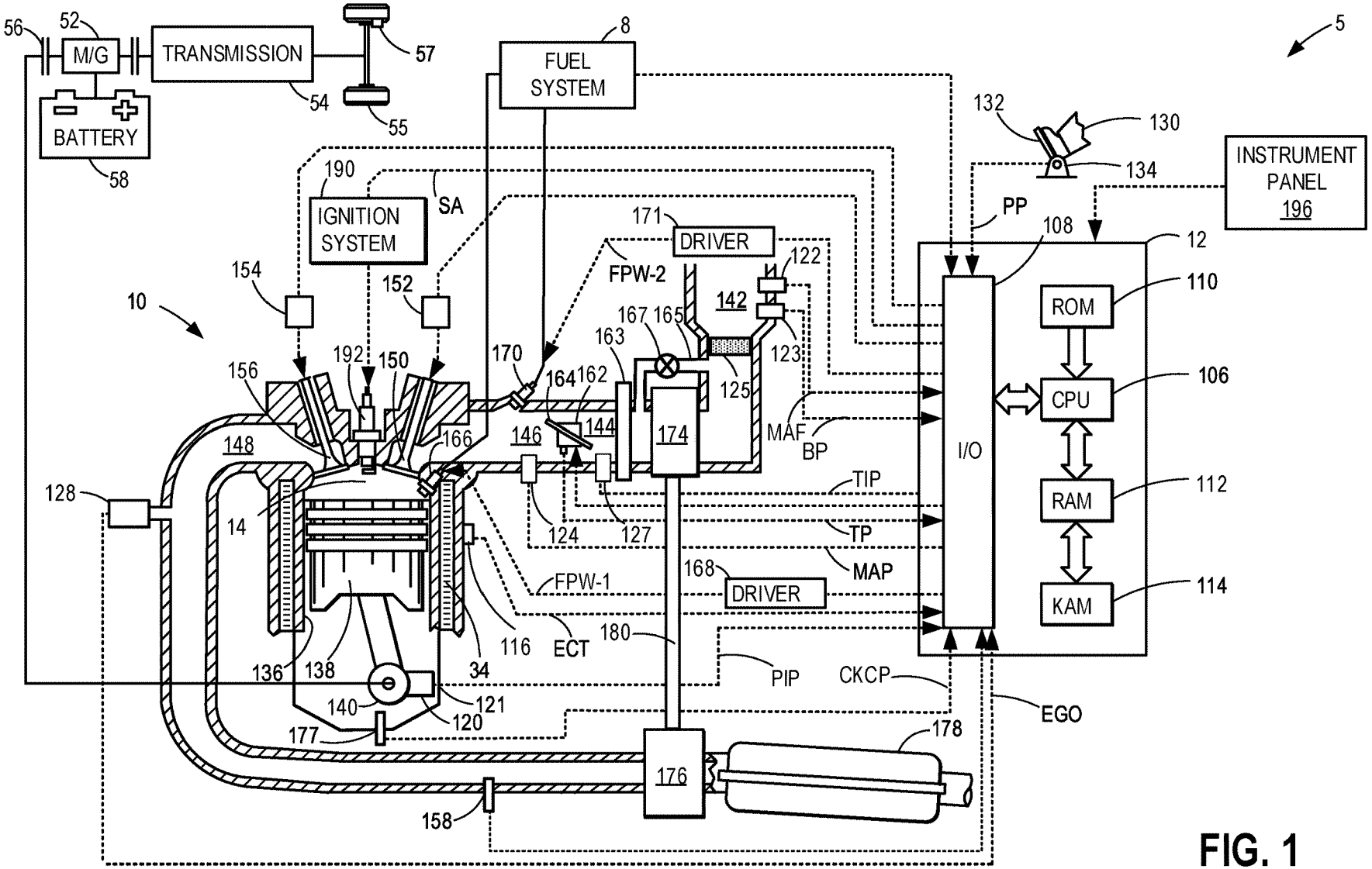
FIG. 1 shows a schematic of an example vehicle system.

The following description relates to systems and methods for operating an engine system of a vehicle, such as the vehicle system of FIG. 1. In particular, the systems and methods herein relate to automatically diagnosing and cleaning blockages of the positive crankcase ventilation (PCV) system of FIG. 2, the PCV system including the PCV valve of FIG. 3, onboard the vehicle system shown in FIG. 1. Methods of diagnosing and cleaning blockages of the PCV system are illustrated in the example flow charts of FIGS. 4-7. A timeline chart for operating the vehicle system of FIG. 1 according to the methods of FIGS. 4-7 is illustrated in FIG. 8.

Turning now to the figures, FIG. 1 depicts an example embodiment of a cylinder 14 of an internal combustion engine 10, which may be included in a vehicle system 5, hereinafter also described as vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation. One or more of the vehicle wheels may have a wheel speed sensor 57 mounted thereto for determining a wheel rotational speed (e.g., a number of revolutions over time) and transmitting the detected value to controller 12. Utilizing the wheel rotational speed(s), the controller 12 may compute and output a vehicle speed at an instrument panel 196.

Cylinder 14 of engine 10 can receive intake air via a series of intake air passages 142, 144, and 146. Intake air passage 146, also be described herein as intake manifold 146, can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted. Intake air may bypass compressor 174 by way of compressor bypass conduit 165, during conditions wherein compressor bypass valve (CBV) 167 is opened. As such, pressure buildup at the compressor inlet may be relieved.

Figure 2:
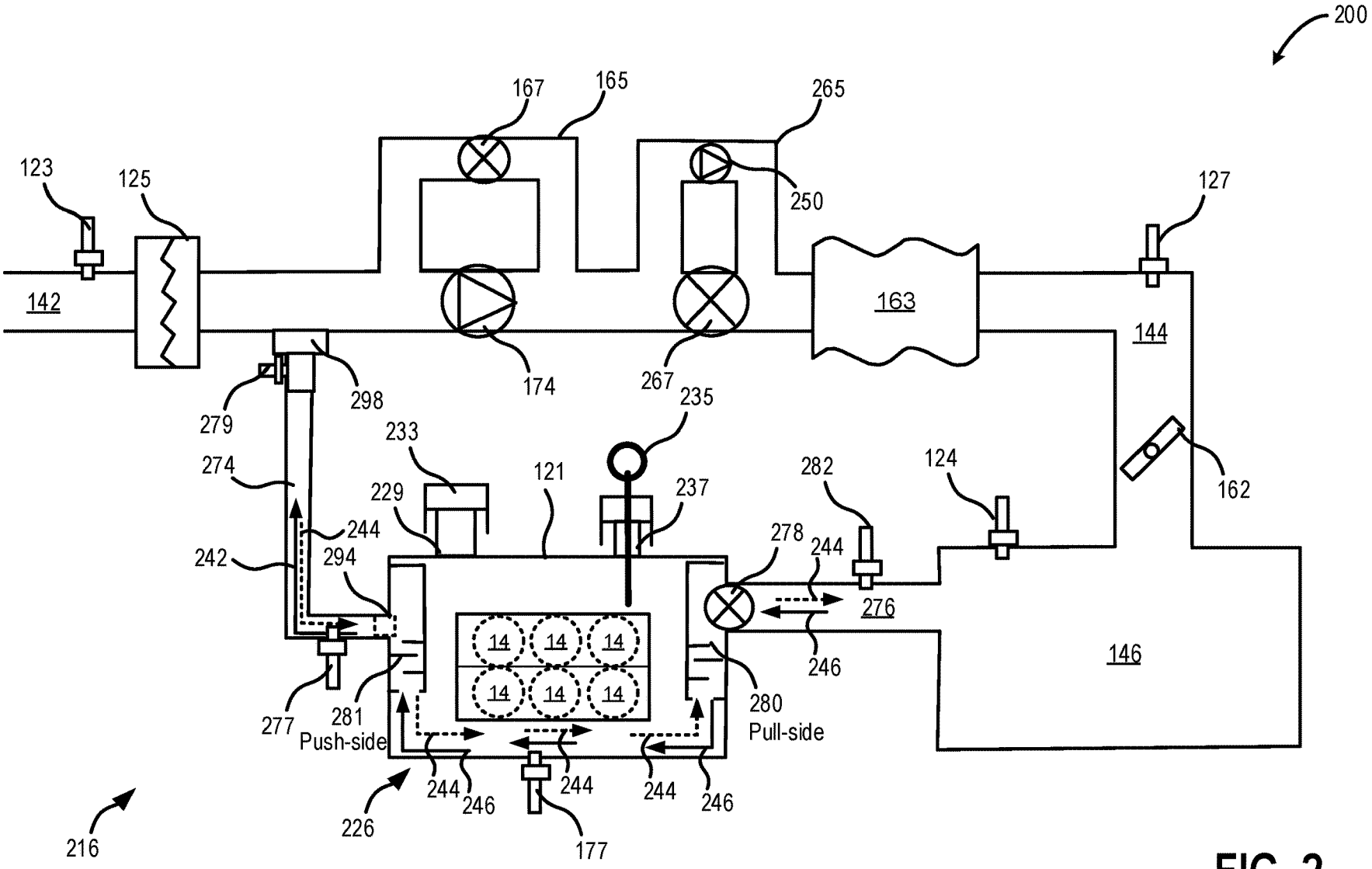
FIG. 2 shows a schematic of a partial engine system including a positive crankcase ventilation (PCV) system for the vehicle system of FIG. 1

In some embodiments of engine system 10, an e-booster 250 may be positioned in intake passages 142 and 144 upstream and/or downstream from the compressor 174, as shown in FIG. 2. E-booster 250 may include an electrically-driven compressor positioned upstream or downstream from the compressor 174. The e-booster 250 may be driven by controller 12 to increase boost pressure independently of the compressor 174, and for the case where compressor 174 is configured as a turbocharger, the e-booster 250 may aid in reducing lag in boost response from the turbocharger. Intake air may bypass e-booster 250 by way of e-booster bypass conduit 265, during conditions wherein e-booster bypass valve 267 is opened.

A throttle 162 including a throttle plate 164 may be provided in the engine intake passages 144 and 146 for varying the flow rate and/or pressure of intake air provided to the engine cylinders 14. For example, throttle 162 may be positioned downstream of compressor 174, as shown in FIG. 1, or may be alternatively provided upstream of compressor 174. The throttle 162 may be disposed in the engine intake to control the airflow entering intake manifold 146 and may be preceded upstream by compressor 174 followed by charge air cooler 163, for example. An air filter 125 may be positioned upstream of compressor 174 and may filter fresh air entering intake passage 142. The intake air may enter combustion chamber 14 by way of an electrically-actuated intake valve system. Likewise, combusted exhaust gas may exit combustion chamber or cylinder 14 by an electrically-actuated exhaust valve system. In an alternate embodiment, one or more of the intake valve system and the exhaust valve system may be cam-actuated. The intake and exhaust valve systems, and control thereof, are discussed in further detail herein.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may include one or more of a three-way catalyst (TWC), a NOx trap, a selective catalyst reduction (SCR) catalyst, a diesel particulate filter (DPF), various other emission control devices, or combinations thereof.

Engine 10 may include a lower portion of the engine block, which may include a crankcase 121 encasing the crankshaft 140, and an oil well (not shown) positioned below the crankshaft with oil for lubricating the crankshaft 140. As shown in FIG. 2, crankcase 121 may further include an oil fill port 229 disposed in crankcase 121 so that oil may be supplied to the oil well. Oil fill port 229 may include an oil cap 233 to seal oil fill port 229 when the engine 10 is in operation. A dip stick tube 237 may also be disposed in crankcase 121 and may include a dipstick 235 for measuring a level of oil in the oil well. A crankcase pressure (CKCP) sensor 177 may be positioned at the crankcase 121 for measuring a crankcase pressure. The CKCP signal is transmitted to the controller 12 from the CKCP sensor 177. As described further herein, the CKCP sensor 177 may aid in determining when a crankcase separator is clogged. In addition, crankcase 121 may include a plurality of other orifices for servicing components in crankcase 121. These orifices in crankcase 121 may be maintained closed during engine operation so that a positive crankcase ventilation (PCV) system 216 fluidly coupled to the crankcase 121 may operate during engine operation, as is further described herein with reference to FIG. 2.

At an upper portion of the engine block, each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in intake passage 146 rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed. In an alternative embodiment, the vehicle instrument panel 196 may communicate audio messages to the operator without display. In another example, the vehicle instrument panel may also display an SCR deactivation extent. The SCR deactivation extent may be available to a vehicle operator and/or service technician as a data plot showing historical and current data, or as a displayed numerical representation indicating the current % life (100−% SCR deactivation extent) of the SCR catalyst remaining.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 receives signals from the various sensors of FIG. 1 and employs the various actuators of FIG. 1 to adjust engine operation based on the received signals and instructions stored on a memory of the controller. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148; a profile ignition pickup signal (PIP) from a Hall effect sensor 120 (or other type) coupled to crankshaft 140; throttle position (TP) from a throttle position sensor; signal EGO from exhaust gas sensor 128, which may be used by controller 12 to determine the AFR of the exhaust gas; and an absolute manifold pressure signal (MAP) from a MAP sensor 124. During various vehicle operating conditions, controller 12 may infer barometric pressure from the manifold pressure signal MAP. In other examples, correlations between throttle position, engine mass-airflow, and barometric pressure can be utilized in cooperation with engine breathing data. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Turning now to FIG. 2, it illustrates a partial schematic 200 of engine system 10, including the engine intake system and positive crankcase ventilation (PCV) system 216. PCV system 216 is fluidly coupled to the engine intake passage 142 by way of a crankcase vent tube 274, and to the intake manifold 146 by way of a PCV line 276. Crankcase vent tube 274 and PCV line 276 fluidly couple the engine intake to the crankcase 121 so that gases in the crankcase 121 may be vented in a controlled manner from the crankcase 121 to the engine intake. A first side of crankcase vent tube 274 may be mechanically coupled, or connected, to fresh air intake passage 142 upstream of compressor 174 by way of a quick-connect coupling 298 (e.g., clean side quick connect). Quick-connect coupling 298 may include a relief valve mechanism 279 that allows for bi-directional flow (e.g., from intake passage 142 into the crankcase vent tube 274 or from crankcase vent tube 274 into intake passage 142), depending on the intake pressure. In some examples, a first side of the crankcase vent tube 274 may be coupled to intake passage 144 downstream of air filter 125 (as shown). In other examples, the crankcase vent tube 274 may be coupled to intake passage 142 upstream of air filter 125. A second, opposite side of the crankcase vent tube 274 may be mechanically coupled, or connected, to the crankcase 121 by way of another quick-connect coupling 294 (e.g., dirty side quick connect).

During unboosted engine operating conditions (e.g., natural aspiration mode, when manifold pressure (MAP) is less than barometric pressure (BP)), the PCV system 216 draws air into crankcase 121 by way of the crankcase vent tube 274, and vents crankcase gases from the crankcase 121 into the intake manifold 146 by way of PCV line 276. In some examples, PCV line 276 may include a PCV valve 278, which may be an electronically controlled valve that is controlled by controller 12. In one embodiment, the PCV valve 278 may actively or passively vary its flow restriction in response to the pressure drop across it (or flow rate through it), as described with reference to FIG. 3. When the engine is operating in natural aspiration mode, fluid flow through the PCV system 216 and crankcase 121 is represented by the dashed arrows 244. When the engine is operating in boost mode (e.g., MAP is greater than BP), the PCV system 216 draws air into the crankcase 121 from the intake manifold 146 by way of the PCV line 276 and PCV valve 278, and vents crankcase gases from the crankcase 121 into the intake passage 142 by way of the crankcase vent tube 274. Fluid flow through the PCV system 216 and crankcase 121 during boosted engine operation is represented by the solid arrows 246. It will be appreciated that, as used herein, PCV forward flow refers to the flow of gases through PCV line 276 from the crankcase to the intake manifold. Similarly, as used herein, PCV backflow refers to the flow of gases through PCV line 276 from the intake manifold to the crankcase 121.

The gases in crankcase 121 may include un-burned fuel, un-combusted air, and fully or partially combusted gases. Further, lubricant mist may also be present. As such, pull-side and push-side oil separators 280 and 281 may be incorporated in crankcase ventilation system 216 to reduce venting of the lubricant mist from the crankcase through the PCV system. For example, a pull-side oil separator 280 may be positioned at the crankcase 121 to filter oil from vapors exiting crankcase 121 to the PCV line 276 to mitigate their re-entry into the intake manifold 146 during natural aspiration mode. Furthermore, a push-side oil separator 281 may be positioned at the crankcase 121 to remove oil from the stream of gases exiting the crankcases 121 to crankcase vent tube 274 during boosted operation. As such, both the push-side oil separator 281 and the pull-side oil separator 280 may be uni-directional separators, in that they filter and separate oil from fluids exiting the crankcase 121. Furthermore, the push-side oil separator 281 and the pull-side oil separator 280 may be positioned at the crankcase 121 such that fluids in the crankcase 121 flow through the push-side oil separator 281 and the pull-side oil separator 280 prior to flowing to the crankcase vent tube 274 and the PCV line 276, respectively. Additionally, PCV line 276 may also include a vacuum sensor 282 coupled to the PCV system.

As one example, both the push-side oil separator 281 and the pull-side oil separator 280 may be present in a gasoline turbocharged direct injection (GTDI) engine since a flow direction of positive crankcase ventilation gases may be bi-directional, dependent on if the engine is operating in boost or natural aspiration mode. Vehicle driving conditions and/or operator driving tendencies may largely influence when an engine is operating in boost versus natural aspiration mode. For example, when the vehicle is driven mildly (e.g., low load, low acceleration, and the like) over short distances, boost mode may be seldom activated and the engine may be primarily operating in natural aspiration mode. Conversely, when the vehicle is operated under high load (e.g., towing, up steep inclines), engine operation in boost mode may predominate relative to natural aspiration mode. Additionally, during start/stop driving conditions, engine idle opportunities may be fewer, especially for non-hybrid vehicles, and the engine may mostly be operating in a boosted mode.

When the engine is operating in natural aspiration mode, flow of gases from the crankcase vent tube 274 to the crankcase 121 can aid in dislodging and flushing out any oil sludge caught in push-side oil separator 281; however, flow of gases from the crankcase 121 to the PCV line 276 may entrain and increase oil sludge clogging of pull-side oil separator 280. When the engine is operating in boost mode, flow of gases from PCV line 276 to the crankcase 121 can aid in dislodging and flushing out any oil sludge caught in pull-side oil separator 280; however, flow of gases from the crankcase 121 to the crankcase vent tube 274 may entrain and increase oil sludge clogging of push-side oil separator 281. As such, switching between boosted and natural aspiration engine modes during vehicle operation can facilitate bi-directional flow of crankcase gases through the PCV system 216 between the engine intake and the crankcase 121. As such, when an amount (e.g., duration) of boosted engine operation and unboosted (e.g., natural aspiration) engine operation is balanced, the bi-directional flow of crankcase gases can aid in reducing clogging of the push-side oil separator 281 and the pull-side oil separator 280. Conversely, a large difference in an amount (e.g., duration) of boosted engine operation relative to unboosted (e.g., natural aspiration) engine operation may increase clogging of the push-side oil separator 281 and/or the pull-side oil separator 280. Alternately and/or additionally, during engine operating conditions when a cumulative amount (e.g., cumulative duration) of boosted engine operation is less than a threshold boosted duration, a risk of clogging the pull-side oil separator 280 may be higher; similarly, during engine operating conditions when a cumulative amount (e.g., cumulative duration) of unboosted engine operation is less than a threshold unboosted duration, a risk of clogging the push-side oil separator 281 may be higher.

Herein, natural aspiration mode or unboosted engine operation refers to engine operation when intake gases are drawn or "pushed" into the engine solely by atmospheric pressure filling the volumetric void caused by the downward stroke of the cylinder piston (which creates a low-pressure area). In contrast, boost mode or boosted engine operation refers to engine operation when the intake gas (e.g., principally air) is compressed such that the intake manifold pressure exceeds atmospheric pressure, thereby increasing density of the intake gas and increasing engine power per cycle. Boost may refer to an amount by which the intake manifold pressure exceeds atmospheric pressure. Turbocharger and supercharger devices may be utilized to boost engine intake gases. In the example of FIGS. 1 and 2, boosted operation may be initiated by one or more of compressor 174 and e-booster 250. Conversely, when compressor 174 and e-booster 250 are off or bypassed, the engine may operate in natural aspiration mode. Thus, boost level (e.g., the amount of compression of the intake gas) may be controlled by adjusting a speed of compressor 174 and/or e-booster 250.

Crankcase 121 may include the CKCP sensor 177 positioned thereat to measure the crankcase pressure. Crankcase vent tube 274 may further include a sensor 277 coupled therein for providing an estimate regarding air flow through the crankcase vent tube 274 (e.g., air flow rate, pressure, etc.). In some embodiments, sensor 277 coupled at crankcase vent tube 274 may be a pressure sensor. When configured as a pressure sensor, sensor 277 may be an absolute pressure sensor or a gauge sensor. In an alternate embodiment, sensor 277 may be a flow sensor or flow meter. In still another embodiment, sensor 277 may be configured as a venturi. In some embodiments, in addition to a pressure or flow sensor 277, the crankcase vent tube may optionally include a venturi (not shown) for sensing flow therethrough. In still other embodiments, pressure sensor 277 may be coupled to a neck of the venturi to estimate a pressure drop across the venturi. One or more additional pressure and/or flow sensors may be coupled near or at the crankcase ventilation system 216 at alternate locations. For example, a barometric pressure sensor (BP sensor 123) may be coupled to intake passage 142, upstream of air filter 125, for providing an estimate of barometric pressure. In one example, where crankcase vent tube sensor 277 is configured as a gauge sensor, BP sensor 123 may be used in conjunction with gauge pressure sensor 277. In some embodiments, pressure sensor 61 may be coupled in intake passage 144 downstream of air filter 125 and upstream of compressor 174 to provide an estimate of the compressor inlet pressure (CIP). However, since crankcase vent tube pressure sensor 277 may provide an accurate estimate of a compressor inlet pressure during elevated engine air flow conditions (such as during engine run-up), it can supplement CIP measurements from a dedicated CIP sensor. Further still, a pressure sensor 127 may be coupled downstream of compressor 174 for providing an estimate of a throttle inlet pressure (TIP). Any of the above-mentioned pressure sensors may be absolute pressure sensor or gauge sensors.

During engine ON conditions, when the crankcase pressure indicated by CKCP sensor 177 increases above a threshold pressure ($P_{TH1}$), venting of crankcase gases from the crankcase 121 to the engine intake (e.g., intake passage 144 or intake manifold 146) may be obstructed. Obstruction of the crankcase gases flowing from the crankcase 121 may arise from clogging of one or both of the push-side oil separator 281 and the pull-side oil separator 280, which can raise internal engine pressures and increase a risk of engine degradation. As such, onboard diagnosing and cleaning of clogged oil separators in the crankcase 121 can advantageously reduce vehicle service and vehicle downtime, while raising customer satisfaction and vehicle performance.

Figure 3:
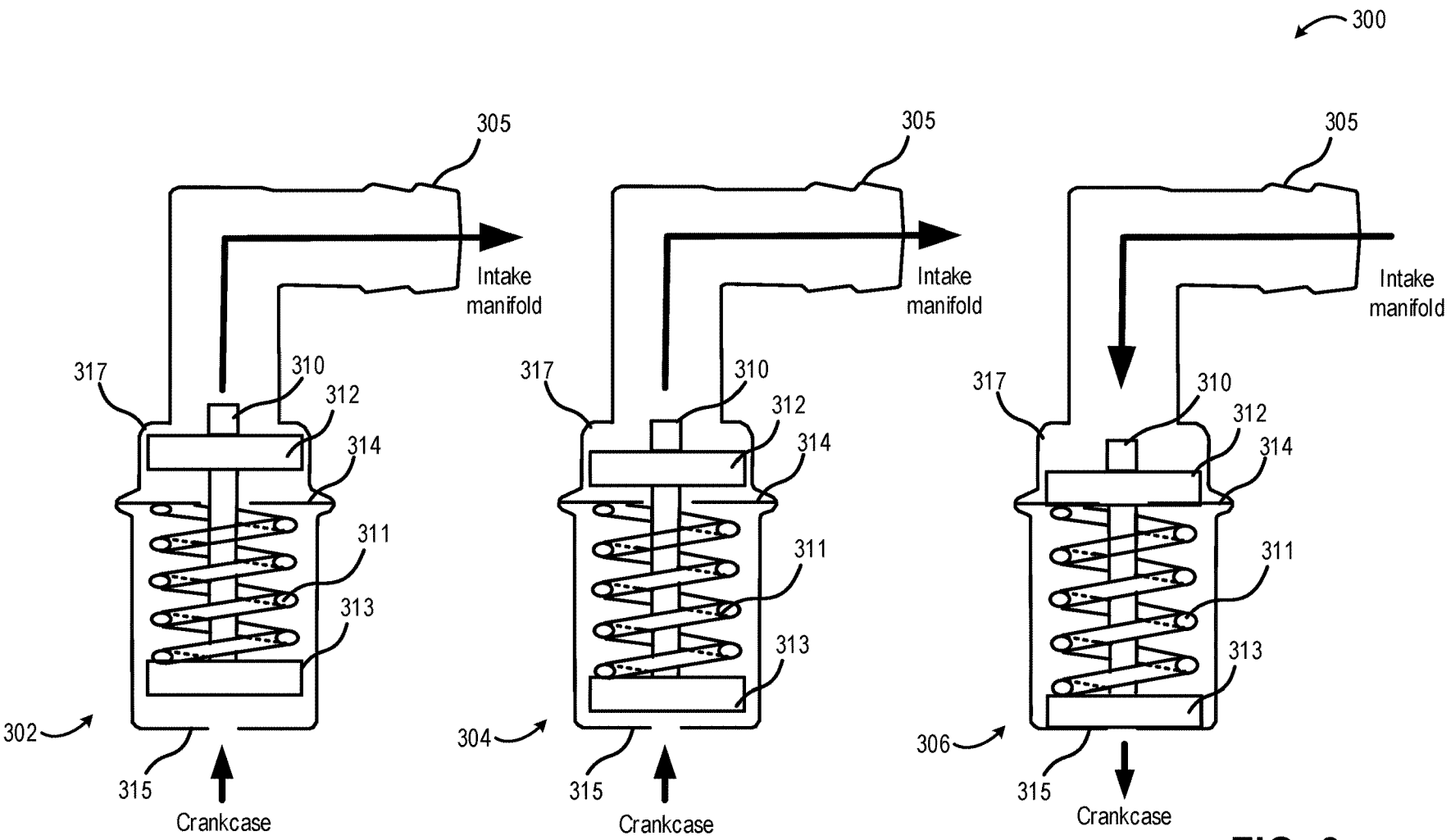
FIG. 3 shows a schematic of a PCV valve during various engine operating conditions.
Figure 4:
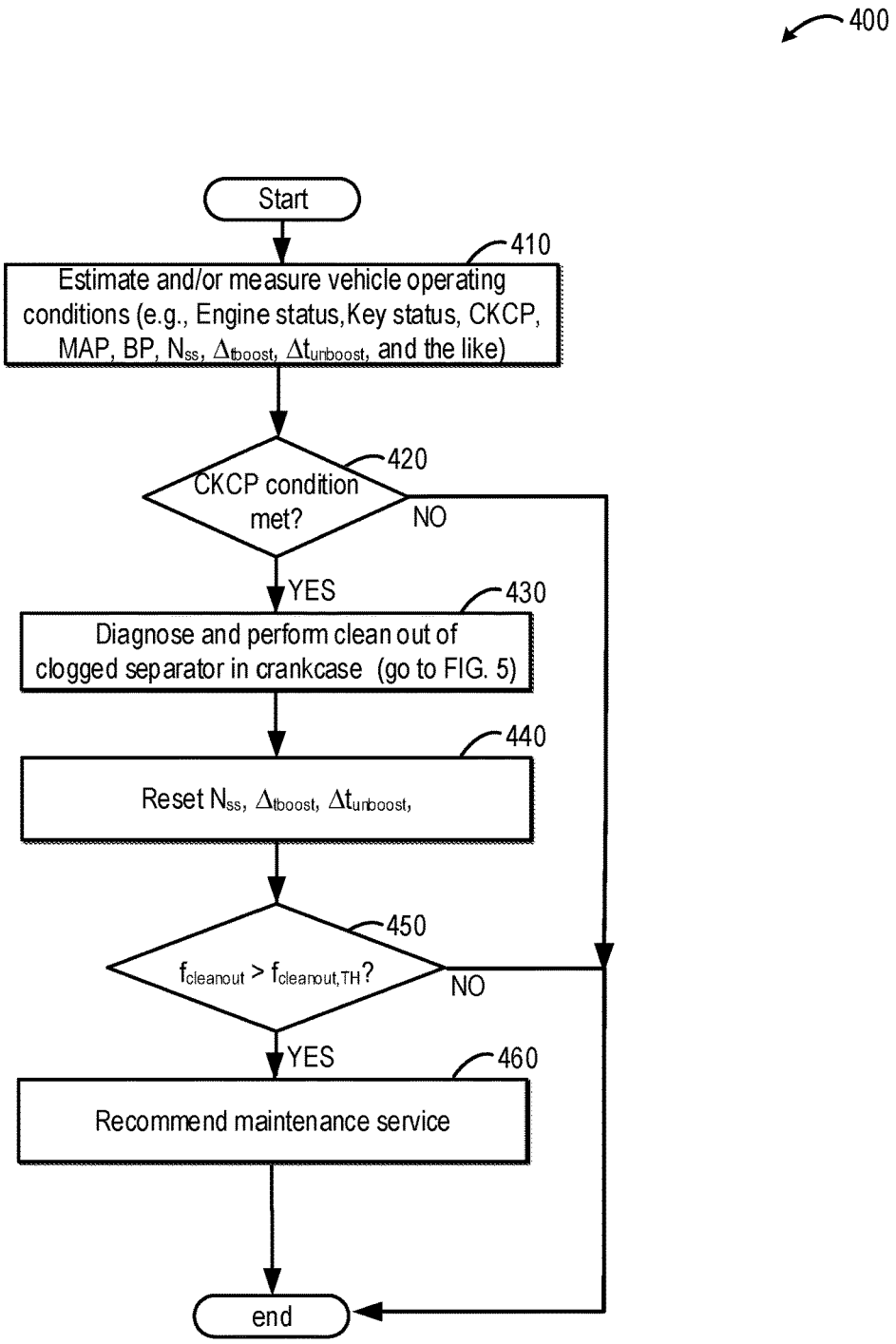
FIGS. 4-7 show flow charts for example methods of operating the vehicle system of FIG. 1 to diagnose and clear blockages in the PCV system of FIG. 2.

Turning now to FIG. 3, schematic 300 depicts the PCV valve 278 of FIG. 2 occupying various configurations as a function of engine operating conditions. It will be appreciated that while FIG. 3 shows PCV valve 278 as a passive valve, this is not meant to be limiting, and in alternate embodiments, PCV valve 278 may be an electronically controlled valve (e.g., a powertrain control module (PCM) controlled valve) wherein a controller 12 may command a signal to change a position of the valve from an open position (or a position of high flow) to a closed position (or a position of low flow), or vice versa, or any position there-between. Schematic 300 shows example illustrations of various conformations 302, 304, 306 of a PCV valve 278 during various engine operating conditions. More specifically, conformation 302 illustrates a PCV valve 278 conformation during lower vehicle speed, high intake manifold vacuum conditions. Conformation 304 illustrates a conformation of PCV valve 278 during higher vehicle speed, lower intake manifold conditions. Conformation 306 illustrates a conformation of PCV valve 278 during conditions of positive pressure with respect to atmospheric pressure in the intake manifold. It may be understood that PCV valve 278 depicted at 302, 304, and 306 may comprise the same PCV valve as PCV valve 278 depicted above at FIG. 2. As examples, configuration 302 may correspond to an idling vehicle condition, configuration 304 may correspond to an accelerating vehicle condition, and configuration 306 may correspond to a boosted vehicle engine condition.

Turning to conformation 302, PCV valve 278 may include a PCV valve housing 305, a plunger 310, and a spring 311. Furthermore, PCV valve 278 may include a first pintle 312, and a second pintle 313. Responsive to conditions of idle speed and high intake manifold vacuum, the high intake manifold vacuum may draw the plunger 310 toward the intake manifold, resulting in the first pintle 312 seating against a valve body seat 317. As such, under high intake manifold vacuum conditions, PCV valve 278 adopts a low flow conformation. In other words, fluid flow from the crankcase 121 through the PCV valve 278 to the intake manifold 146 (e.g., unboosted flow direction) may be reduced as a result of the first pintle 312 seating against the valve body seat 317, and flow being more restricted.

Turning to conformation 304, PCV valve 278 is illustrated under conditions of high engine speed, and low intake manifold vacuum. Responsive to conditions of high engine speed, and low intake manifold vacuum, spring 311 may push first pintle 312 away from valve body seat 317, while not seating (e.g., contacting) first valve seat 314, thus allowing more fluid flow. Furthermore, second pintle 313 may not contact second valve seat 315, and as such, a higher engine speeds, low intake manifold vacuum condition may represent a condition where fluid flow from the crankcase 121 through PCV valve 278 to the intake manifold 146 (e.g., unboosted flow direction) is increased, being less restricted.

Turning to conformation 306, PCV valve 278 is illustrated under conditions of positive intake manifold pressure, such as during boosted conditions. Under such conditions, PCV valve 278 may close. More specifically, positive pressure in the intake manifold may result in the first pintle seating against the first valve seat 314 and second pintle 313 seating against second valve seat 315, thus reducing, and under certain engine operating conditions, preventing, fluid flow from the intake manifold 146 through the PCV valve 278 to the crankcase 121 (e.g., boosted flow direction).

Turning now to FIGS. 4-7, they illustrate flow charts for methods 400, 500, 600, and 700 of operating an engine 10 of a vehicle 5. Instructions for carrying out method 400 and the rest of the methods included herein may be executed by a controller 12 based on instructions stored in non-transitory memory of the controller 12 and in conjunction with signals received from sensors of the engine system 10, such as the sensors described above with reference to FIGS. 1 and 3. The controller 12 may employ engine actuators of the engine system 10 to adjust engine operation, according to the methods described below.

Method 400 presents a general method for diagnosing and performing a crankcase clean out while operating vehicle 5. Method 400 begins at 410 where the controller 12 estimates and/or measures vehicle operating conditions such as CKCP, engine status, key ON/OFF status, MAP, BP, $N_{ss}$, a boosted engine duration $\Delta t_{boost}$, an unboosted engine duration $\Delta t_{unboost}$, and the like. $N_{ss}$ represents a cumulative number of start/stop engine events since the last crankcase clean out has been performed. $\Delta t_{boost}$ refers to a cumulative duration that the engine has been ON and operating in a boosted mode since the last crankcase clean out has been performed, while $\Delta t_{unboost}$, refers to a cumulative duration that the engine has been ON and operating in an unboosted mode (e.g., natural aspiration mode) since the last crankcase clean out has been performed. $\Delta t_{boost}$ may be determined by controller 12 by tracking a cumulative duration a compressor 174 and/or e-booster 250 is ON, and/or when the MAP>BP when the engine is ON, while $\Delta t_{unboost}$ may be determined by controller 12 by tracking a cumulative duration a compressor 174 and/or e-booster 250 is OFF, and/or when a MAP<BP when the engine is ON.

After 410, method 400 continues at 420, where the controller 12 determines if a CKCP condition is met. In one example, the CKCP condition being met includes when CKCP is greater than a threshold pressure ($P_{TH1}$) while the engine is ON. As described herein, CKCP may be determined by the CKCP sensor 177 positioned at the crankcase 121. $P_{TH1}$ may correspond to a pressure above which a risk of one or more oil separators at the crankcase 121 may be clogged is elevated as compared to when CKCP is less than $P_{TH1}$. In one example, $P_{TH1}$ may be greater than the boosted pressure when the engine is operating in boost mode such that $P_{TH1}$>MAP when compressor 174 and/or e-Booster 250 are ON. In other examples, $P_{TH1}$ may be determined empirically and calibrated through data collection over a range of engine operating conditions and may depend on factors including, but not limited to, engine size, turbo size, drive cycle to drive cycle conditions, and the like. As such, in response to CKCP>$P_{TH1}$ while the engine is ON, method 400 continues at 430 where the controller 12 diagnoses the clogged crankcase, and performs a clean out of the crankcase 121.

As another example, the CKCP condition being met may additionally or alternatively include when a rate of change of CKCP, $CKCP_{ROC}$, is greater than a CKCP threshold rate of change, $CKCP_{ROC,TH1}$ while the engine is ON. As one or more of the push-side and pull-side oil separators become clogged, CKCP may increase more quickly and may be more sensitive to inflow of gases delivered to the crankcase from PCV forward flow and PCV backflow, respectively, as compared to when one or more of the oil separators are not clogged. Thus, $CKCP_{ROC,TH1}$ may refer to a rate of change in CKCP above which a risk of one of the push-side and pull-side oil separators clogging is increased as compared to when the push-side and pull-side oil separators are not clogged. $CKCP_{ROC,TH1}$ may be determined empirically and calibrated through data collection over a range of engine operating conditions and may depend on factors including, but not limited to, engine size, turbo size, drive cycle to drive cycle conditions, and the like.

Diagnosing the clogged crankcase may include determining a location of a clogged crankcase oil separator, as further described with reference to method 500 of FIG. 5. After diagnosing and performing a clean out of the crankcase 121, method 400 proceeds to 440 where the controller 12 resets the values for $N_{ss}$, $\Delta t_{boost}$, and $\Delta t_{unboost}$. Next, method 400 continues at 450 where the controller 12 determines if a crankcase clean out frequency, $f_{cleanout}$, is greater than a threshold crankcase clean out frequency, $f_{cleanout,TH}$. $f_{cleanout,TH}$ may represent a threshold crankcase clean out frequency above which additional service of the PCV system 216 may be recommended by the controller 12. $f_{cleanout,TH1}$ may be determined empirically and calibrated through data collection over a range of engine operating conditions and may depend on factors including, but not limited to, engine size, turbo size, drive cycle to drive cycle conditions, and the like. For the case where $f_{cleanout}$>$f_{cleanout,TH}$, method 400 continues at 460, where the controller 12 provides an onboard indication to recommend maintenance service of the engine to the vehicle operator. As one example, controller 12 may provide a visual indication at instrument panel 196 to obtain maintenance service of the PCV system. After 460, and returning to 450 for the case where $f_{cleanout}$ is not greater than $f_{cleanout,TH}$, and returning to 420 for the case where the CKCP is not met, method 400 ends.

Figure 5:
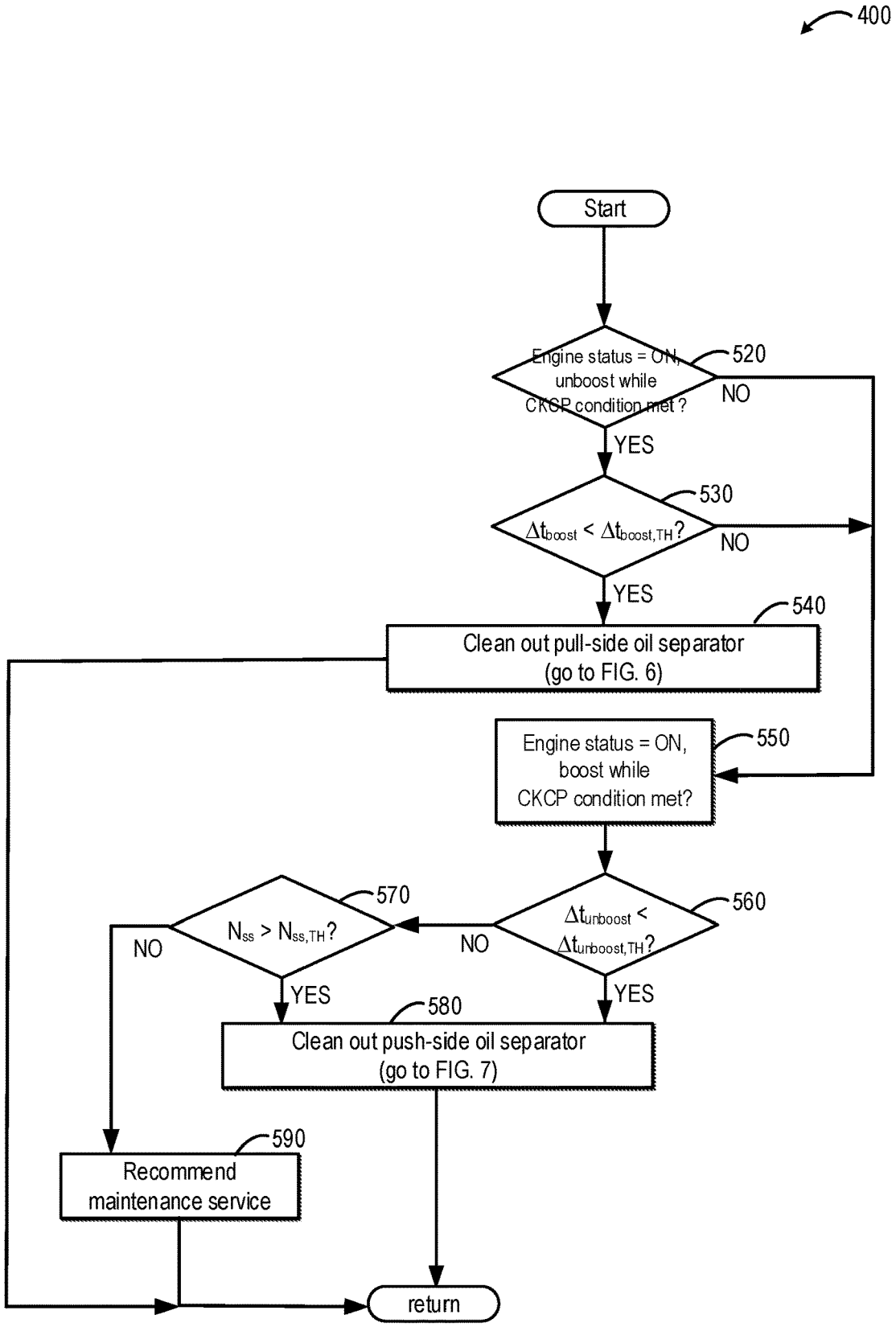

Turning now to FIG. 5, it illustrates a flow chart for a method of determining a location of a clogged oil separator at the crankcase 121. Method 500 may be executed by controller 12 in response to CKCP>$P_{TH1}$ at 420 of method 400 in FIG. 4. Method 500 begins at 520 where the controller 12 determines if the engine is ON and in the unboosted mode while the CKCP condition is met (e.g., CKCP>$P_{TH1}$). CKCP increasing above $P_{TH1}$ while the engine is operating in an unboosted mode can indicate that the pull-side oil separator 280 is clogged because gases are drawn into the crankcase 121 from the crankcase vent tube 274, which tends to dislodge oil sludge entrained in push-side oil separator 281, and because crankcase gases are vented to the PCV line 276 by way of the pull-side oil separator 280, which may entrain oil sludge in pull-side oil separator 280. The pull-side oil separator 280 being clogged may further be indicated by the cumulative duration of boosted engine operation since the last crankcase clean out being below a threshold boosted duration (e.g., $\Delta t_{boost,TH}$). As such, during conditions where the engine is ON and in unboosted mode when CKCP increases above $P_{TH1}$, method 500 proceeds to 530, where the controller 12 monitors historical drive cycles since the last crankcase clean out to determine a cumulative engine ON boosted duration, and determines if $\Delta t_{boost}<\Delta t_{boost,TH}$. $\Delta t_{boost,TH}$ may represent a threshold boosted engine duration (since the last crankcase clean out) below which the engine has been predominantly operating in natural aspiration mode such that a risk of clogging of the pull-side oil separator 280 is higher. $\Delta t_{boost,TH}$ may be determined empirically and calibrated through data collection over a range of engine operating conditions and may depend on factors including, but not limited to, engine size, turbo size, drive cycle to drive cycle conditions, and the like.

During engine operating conditions when $\Delta t_{boost}<\Delta t_{boost,TH}$ is met, oil sludge entrained by fluid flow through the crankcase 121 during unboosted engine operation (e.g., fluid flow represented by dashed arrows 244) may build up and occlude the pull-side oil separator 280 because an amount of fluid flow through the crankcase 121 during boosted engine operation in the opposite direction (e.g., fluid flow represented by solid arrows 246) is reduced. In this way, the controller 12 may diagnose a clogged crankcase pull-side oil separator in response to a first condition being met, the first condition being met including when CKCP>$P_{TH1}$ while the engine is operating in an unboosted state. In one example, the first condition being met may also include when $\Delta t_{boost}<\Delta t_{boost,TH}$. As such, method 500 continues at 540 where the controller 12 proceeds to clean out the pull-side oil separator 280, as further described with reference to FIG. 6.

Returning to 520 for the case where the engine status is not ON and unboosted while CKCP>$P_{TH1}$, and returning to 530 for the case where $\Delta t_{boost}$ is not less than $\Delta t_{boost,TH}$, method 500 continues at 550 where the controller 12 determines that the engine status is ON and operating in boost mode when the CKCP condition is met (e.g., CKCP increases above $P_{TH1}$). CKCP increasing above $P_{TH1}$ while the engine is operating in a boosted mode can indicate that the push-side oil separator 281 is clogged because gases are drawn into the crankcase 121 from the PCV line 276, which tends to dislodge oil sludge entrained in pull-side oil separator 280, and because crankcase gases are vented to the crankcase vent tube 274 by way of the push-side oil separator 281, which may entrain oil sludge in push-side oil separator 281. The push-side oil separator 281 being clogged may further be indicated by the cumulative duration of unboosted engine operation since the last crankcase clean out being below a threshold unboosted duration (e.g., $\Delta t_{unboost,TH}$). As such, during conditions where the engine is ON and in boosted mode when CKCP increases above $P_{TH1}$, method 500 proceeds to 560, where the controller 12 monitors historical drive cycles since the last crankcase clean out to determine a cumulative engine ON unboosted duration, and determines if $\Delta t_{unboost}<\Delta t_{unboost,TH}$. $\Delta t_{unboost,TH}$ may represent a threshold unboosted duration (since the last crankcase clean out) below which the engine has been predominantly operating in boosted mode such that a risk of clogging of the push-side oil separator 281 is higher. $\Delta t_{unboost,TH}$ may be determined empirically and calibrated through data collection over a range of engine operating conditions and may depend on factors including, but not limited to, engine size, turbo size, drive cycle to drive cycle conditions, and the like.

The cumulative number of start/stop engine events since the last crankcase clean out being greater than a threshold number (e.g., $N_{ss,TH}$) may further indicate that the push-side oil separator 281 is clogged because the engine may operate predominantly in boosted mode during engine start/stop events. As such, for the case where $\Delta t_{unboost}$ is not less than $\Delta t_{unboost,TH}$, the method 400 proceeds to 570 where the controller 12 determines if a cumulative number of engine start/stop events since the last crankcase clean out, $N_{ss}$, is greater than a threshold number of start/stop events, $N_{ss,TH}$. $N_{ss,TH}$ may correspond to a cumulative number of start/stop events since the last crankcase clean out above which an amount (e.g., duration) of engine operation in boosted mode is higher such that a risk of clogging of the push-side oil separator 281 is increased. $N_{ss,TH}$ may be determined empirically and calibrated through data collection over a range of engine operating conditions and may depend on factors including, but not limited to, engine size, turbo size, drive cycle to drive cycle conditions, and the like.

In this way, the controller 12 may diagnose a clogged crankcase push-side oil separator in response to a second condition being met, the second condition being met including when CKCP>$P_{TH1}$ while the engine is operating in a boosted mode. In one example, the second condition being met may also include when $\Delta t_{unboost}<\Delta t_{unboost,TH}$. In another example, the second condition being may also include when $N_{ss}>N_{ss,TH}$.

For the case where $N_{ss}>N_{ss,TH}$ at 570, or for the case where $\Delta t_{unboost}<\Delta t_{unboost,TH}$ at 560, method 500 continues at 580 where the controller 12 performs a clean out of the push-side oil separator 281, as described with reference to FIG. 7. Returning to 570, for the case where $N_{ss}$ is not greater than $N_{ss,TH}$, method 500 continues at 590, where the controller 12 recommends engine maintenance service to the vehicle operator, for example, by way of instrument panel 196. After 540, 580, and 590, method 500 returns to method 400 after 430.

In another representation, a dual clog of both the push-side oil separator 281 and the pull-side oil separator 280 may be indicated responsive to CKCP remaining above a lower threshold pressure ($P_{TH2}$) following a key off engine shutdown (engine OFF). A CKCP above $P_{TH2}$ during key OFF engine shutdown conditions may indicate that a risk of both the push-side oil separator 281 and the pull-side oil separator 280 being at least partially clogged may be higher as compared to when CKCP<$P_{TH2}$. Because both the push-side and pull-side both oil separators are clogged at the same time, venting of the crankcase gases is substantially reduced causing CKCP to remain elevated above $P_{TH2}$, even when the engine is shutdown (OFF) at key OFF. In one example, $P_{TH2}$ may be atmospheric pressure ($P_{atm}$). In other examples, $P_{TH2}$ may be determined empirically and calibrated through data collection over a range of engine operating conditions and may depend on factors including, but not limited to, engine size, turbo size, drive cycle to drive cycle conditions, and the like. In another example, a dual clog of both the push-side oil separator 281 and the pull-side oil separator 280 may be indicated responsive to CKCP differing from atmospheric pressure by more than a threshold pressure difference ($\Delta P_{TH}$) at key OFF engine shutdown. In particular, a magnitude of ($CKCP-P_{atm}$) being greater than $\Delta P_{TH}$ at key OFF engine OFF indicates that both the push-side oil separator 281 and the pull-side oil separator 280 may be at least partially clogged to such a degree as to prevent equalization of CKCP to $P_{atm}$.

Additionally or alternatively, in another representation, while the CKCP condition is met, $\Delta t_{unboost}-\Delta t_{boost}$, or the magnitude of ($\Delta t_{unboost}-\Delta t_{boost}$) being less than a threshold duration difference ($\Delta t_{TH}$) may indicate that both the push-side oil separator 281 and the pull-side oil separator 280 are clogged. When the magnitude of $\Delta t_{unboost}-\Delta t_{boost}$ is less than a threshold duration difference, operation of the engine system 10 in boosted and unboosted modes is approximately equivalent. As such, entrained oil sludge clogging the push-side oil separator 281 (during crankcase gases venting to the crankcase vent tube 274 during boosted engine operation) may not entirely cleared by crankcase gases entering the crankcase from the crankcase vent tube 274 during unboosted engine operation. Similarly, entrained oil sludge clogging the pull-side oil separator 280 (during crankcase gases venting to the PCV line 276 during unboosted engine operation) may not entirely cleared by crankcase gases entering the crankcase from the PCV line 276 during boosted engine operation. Atm may be determined empirically and calibrated through data collection over a range of engine operating conditions and may depend on factors including, but not limited to, engine size, turbo size, drive cycle to drive cycle conditions, and the like.

In one embodiment, for the case where both the push-side oil separator 281 and the pull-side oil separator 280 are clogged at the same time, the controller 12 may first perform a clean out of one of the push-side oil separator or a clean out of the pull-side oil separator. Subsequently, if one or more of the push-side oil separator 281 and the pull-side oil separator 280 are still clogged, the CKCP condition may remain being met while the engine is ON, and the controller 12 may proceed by performing a clean out of the other of the push-side oil separator or a clean out of the pull-side oil separator. As such, the crankcase clogs in both oil separators may be cleared by the controller 12 alternating between performing a clean out of push-side oil separator and performing a clean out of the pull-side oil separator to clear the clogged crankcase.

Figure 6:
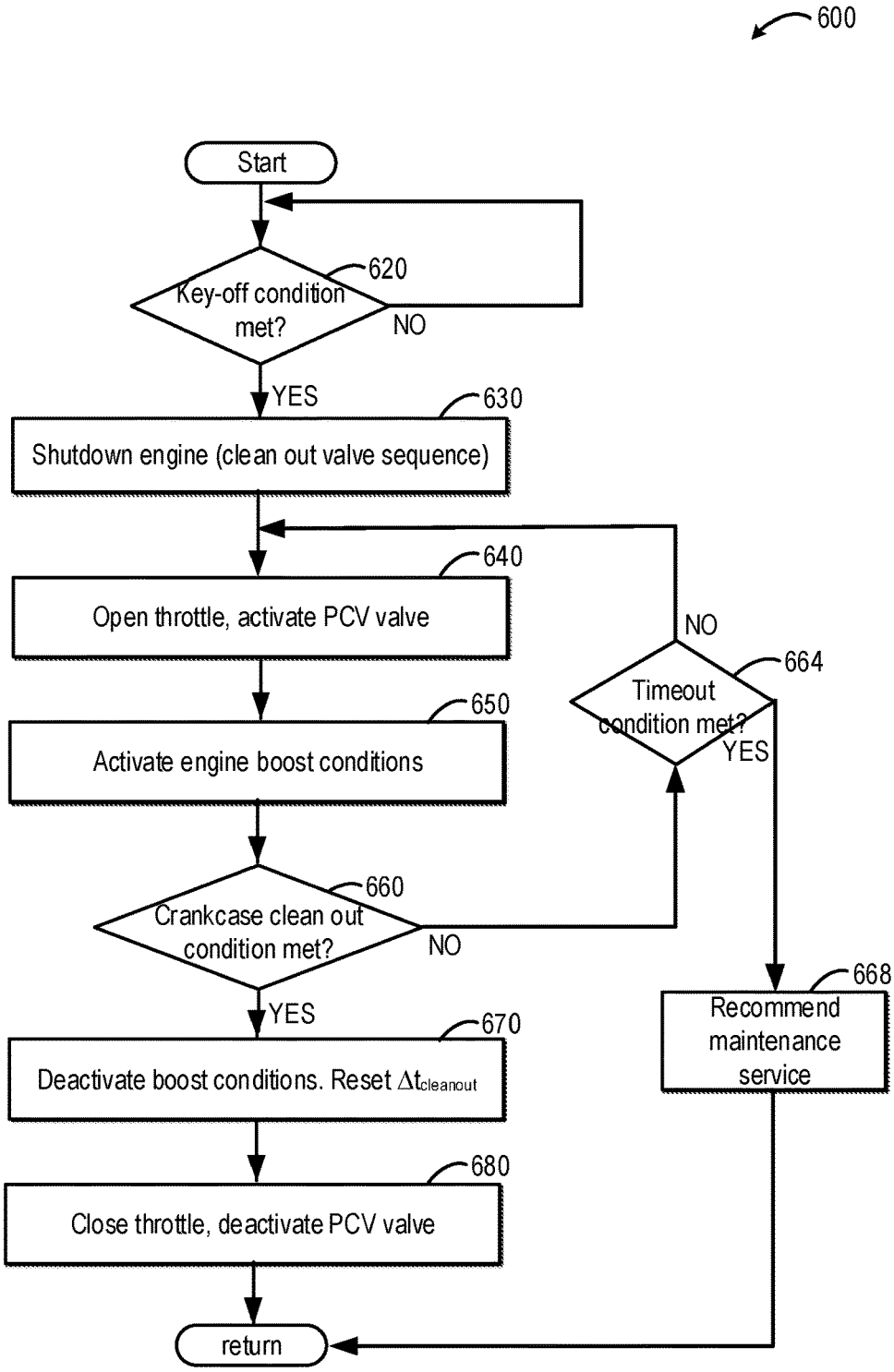

Turning now to FIG. 6, it illustrates a method 600 for cleaning out the crankcase pull-side oil separator 280. Cleaning out the crankcase pull-side oil separator 280 is scheduled for and started at the next key-off condition once the position of the clog is determined to be at the pull-side oil separator 280 (at 540 of method 500). As such, method 600 begins at 620 where the controller 12 determines if a key-off condition is met. Performing the clean out of the crankcase pull-side oil separator 280 during key-off condition aids in ensuring that the clean out does not adversely impact vehicle operation and performance. For the case where the key-off condition is not met, method 600 returns to 620. For the case where the key-off condition is met, method 600 proceeds to 630 where the controller 12 may prepare for the crankcase clean out by shutting down the engine. Shutting down the engine may include shutting down the engine by way of a crankcase clean out cylinder valve sequence. In one example, the crankcase clean out cylinder valve sequence may include controlling the sequence of opening and shutting the cylinder valves to reduce, as much as possible, fluid communication between the engine intake and exhaust systems during the engine shut down.

In one embodiment, shutting down the engine may include controlling the intake poppet valves and the exhaust poppet valves to prevent fluid communication between the engine intake and the engine exhaust. As an example, controlling the cylinder valves to reduce fluid communication between the engine intake and exhaust may include closing the intake poppet valves 150 while the exhaust poppet valves 156 are open, and closing the exhaust poppet valves 156 while the intake poppet valves 150 are open. Reducing fluid communication between the engine intake and exhaust systems during engine shutdown may reduce a risk of particulate from the engine exhaust and/or engine cylinders from entering the engine intake during engine shutdown, which can aid in decreasing a risk of particulate being entrained into the crankcase during the crankcase clean out.

Following 630, method 600 continues at 640 where the controller 12 may open the throttle 162 and activate PCV valve 278. Opening the throttle 162 may include opening the throttle 162 wide open (e.g., 100% open) so that a flow of air from the engine intake to the crankcase 121 during the crankcase clean out can be higher. In another example, opening the throttle 162 may include opening the throttle 162 above a threshold throttle open position to increase air flow. The threshold open throttle position may be determined empirically and calibrated through data collection over a range of engine operating conditions and may depend on factors including, but not limited to, engine size, turbo size, drive cycle to drive cycle conditions, and the like. Activating the PCV valve 278 may include fully opening the PCV valve 278 (in the case of an electronically controlled PCV valve 278) so that flow of air from the engine intake to the crankcase 121 during the crankcase clean out can be higher.

Next, method 600 continues at 650 where the controller 12 activates engine boost conditions, for example, activating the e-booster 250. Activating the e-booster aids in delivering air flow from the engine intake passages 142, 144, and intake manifold 146 into the crankcase 121 (e.g., PCV backflow, in the direction of solid arrows 246) while the engine is shutdown during key-off conditions. The flow of air from the engine intake into the crankcase 121 aids in dislodging oil sludge from the pull-side oil separator 280 during the crankcase clean out. In some examples, where the engine does not include an e-booster, at 650, the controller 12 may activate engine boost conditions by way of activating a supercharger or other compressor 174 to deliver flow of compressed air (compressed so that air pressure is greater than BP) from the engine intake into the crankcase 121 to clean out the crankcase 121.

In contrast to the engine shutdown sequence described with reference to 630 and 640, when the CKCP condition is not met (e.g., no crankcase clog is diagnosed), shutting down the engine may include the controller 12 controlling the cylinder valves without preventing fluid communication between the intake and exhaust systems, including, but not limited to, opening the intake poppet valves 150 while the exhaust poppet valves 156 are open, and opening the exhaust poppet valves 156 while the intake poppet valves 150 are open. Furthermore, the throttle 162 is not commanded open beyond the threshold throttle open position during engine shutdown when the CKCP condition is not met.

Following 650, method 600 continues at 660 where controller 12 determines if a crankcase clean out condition is met. In one example, the crankcase clean out condition may be met when a PCV backflow flow rate, $Q_{PCV,back}$, measured by CKCP sensor 177 and/or sensor 277, is greater than a threshold backflow rate, $Q_{PCV,back,TH}$. CKCP sensor 177 and/or sensor 277 may measure the PCV backflow flow rate by measuring one or more of a change in pressure, or by measuring a flow rate direction (e.g., when sensor 277 may be configured as a flow sensor). The threshold backflow rate may correspond to a crankcase gas flow rate (e.g., a PCV backflow flow rate) above which oil sludge clogging of the pull-side oil separator 280 is dislodged and cleared out. In one example, the threshold backflow rate may be 0; as such, when the PCV backflow flow rate becomes measurably greater than 0, the crankcase clean out condition is met. In other examples, $Q_{PCV,back,TH}$ may be determined empirically and calibrated through data collection over a range of engine operating conditions and may depend on factors including, but not limited to, engine size, turbo size, drive cycle to drive cycle conditions, and the like.

For the case where the crankcase clean out condition is not met, method 600 continues to 664 where the controller 12 determines if a crankcase clean out timeout condition has been met. The timeout condition may refer to a condition evaluated during the crankcase clean out that, when satisfied, indicates that clogging of the crankcase is severe and that the crankcase clean out is insufficient to dislodge and clear the clogged separator. In one example, the timeout condition may be met when a clean out duration, $\Delta t_{cleanout}$, is greater than a threshold clean out duration, $\Delta t_{cleanout,TH}$. $\Delta t_{cleanout}$ refers to a length of time since the engine boost conditions have been activated at 650, while key-off conditions are met and the engine is shut down. $\Delta t_{cleanout,TH}$ may correspond to a threshold duration beyond which the crankcase clean out is unable to alleviate clogging of the pull-side oil separator 280. $\Delta t_{cleanout,TH}$ may be determined empirically and calibrated through data collection over a range of engine operating conditions and may depend on factors including, but not limited to, engine size, turbo size, drive cycle to drive cycle conditions, and the like.

$\Delta t_{cleanout}$ being greater than $\Delta t_{cleanout,TH}$ (while the crankcase clean out condition has not been met) may indicate that clogging of the pull-side oil separator 280 may be too severe for the crankcase clean out. In another example, the timeout condition may be met when a rate of change in CKCP during the crankcase clean out is less than a lower threshold CKCP rate of change, $CKCP_{ROC,TH2}$. In one example, the threshold CKCP rate of change may be zero. $CKCP_{ROC,TH2}$ may be determined empirically and calibrated through data collection over a range of engine operating conditions and may depend on factors including, but not limited to, engine size, turbo size, drive cycle to drive cycle conditions, and the like. In another example the timeout condition may be met when a rate of change in the PCV backflow flow rate from the crankcase 121 to the crankcase vent tube 274 is less than a lower threshold PCV backflow rate of change. In one example, the threshold rate of change in the PCV backflow flow rate may be 0. In other examples, the lower threshold PCV backflow rate of change may be determined empirically and calibrated through data collection over a range of engine operating conditions and may depend on factors including, but not limited to, engine size, turbo size, drive cycle to drive cycle conditions, and the like.

In one example, the timeout condition may be met when one of, two of, or all of $\Delta t_{cleanout}$ being greater than $\Delta t_{cleanout,TH}$, a rate of change in CKCP being less than the lower threshold CKCP rate of change, and a rate of change in the PCV backflow flow rate being less than the lower threshold rate of change in the PCV backflow flow rate is met. Responsive to the timeout condition being met, method 600 continues at 668 where the controller 12 may send a message to the vehicle operator to recommend maintenance service. Returning to 664 for the case when the timeout condition is not met, method 600 returns to 640 where the controller 12 maintains the throttle 162 open, maintains the PCV valve 278 activated, and maintains the engine boost conditions activated.

Returning to 660, for the case where the crankcase clean out condition is met, method 600 continues to 670 where the controller 12 deactivates boost conditions to stop PCV backflow of air into the crankcase 121 by way of the PCV line 276. As examples, deactivating the boost conditions can include one or more of deactivating the e-booster 250, deactivating the supercharger, and deactivating compressor 174. At 670, the controller 12 also resets $\Delta t_{cleanout}$. Next, method 600 continues at 680 where the controller 12 closes the throttle 162 and deactivates the PCV valve 278, thereby ending the crankcase clean out. After 680, and after 668, method 600 returns to method 500 after 540.

Figure 7:
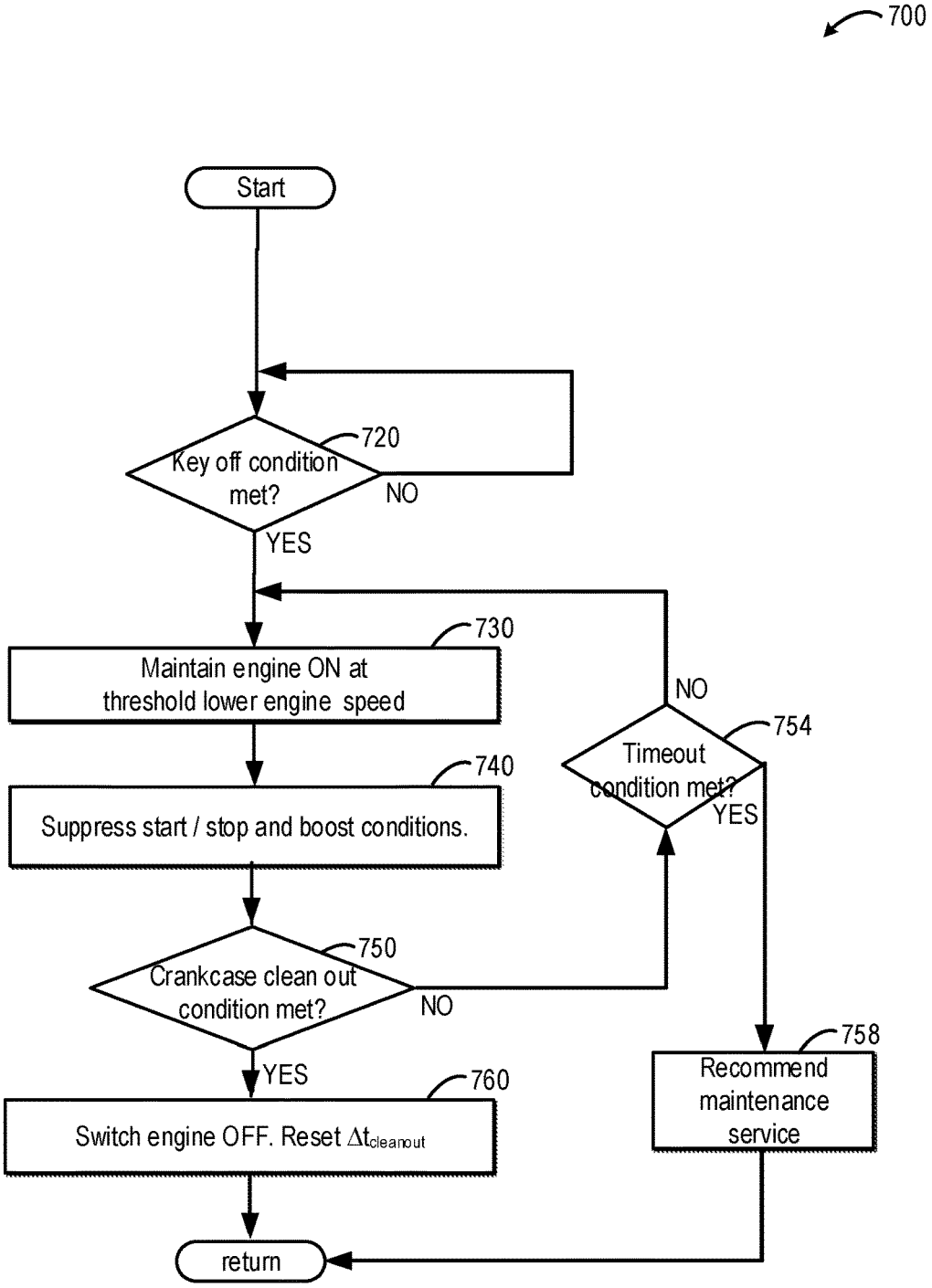
Figure 8:
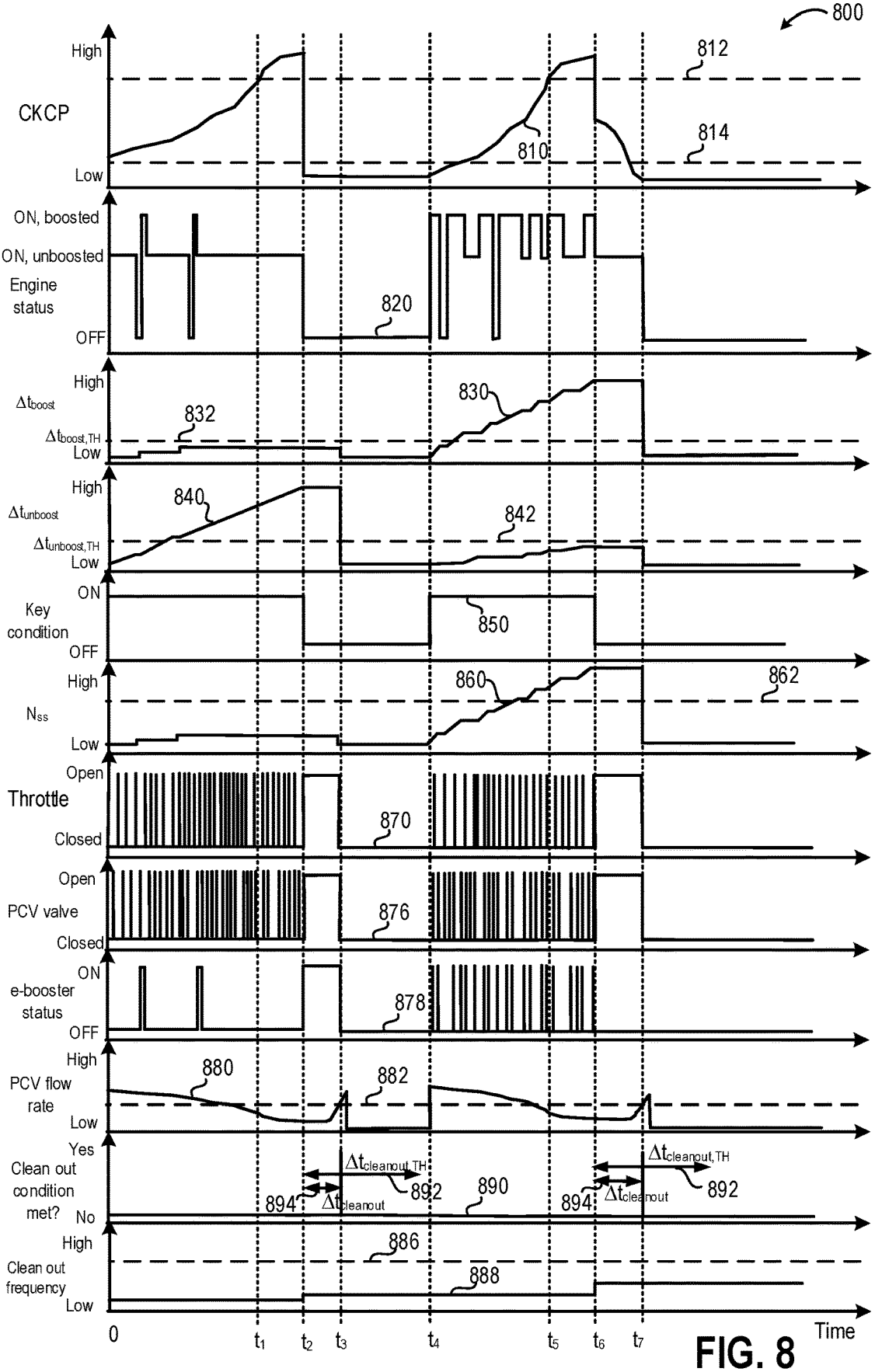
FIG. 8 shows an example timeline for performing the methods of FIGS. 4-7.

Turning now to FIG. 7, it illustrates a flow chart for an example method 700 of cleaning out a crankcase push-side oil separator 281. Cleaning out the crankcase push-side oil separator 281 is scheduled at the next key-off condition once the position of the clog is determined to be at the push-side oil separator 281 (at 580 of method 500). As such, method 700 begins at 720 where the controller 12 determines if a key-off condition is met. Performing the clean out of the crankcase push-side oil separator 281 during the key-off condition aids in ensuring that the clean out does not adversely impact vehicle operation and performance. For the case where the key-off condition is not met, method 700 returns to 720. For the case where the key-off condition is met, method 700 proceeds to 730 where the controller 12 maintains engine ON at a lower threshold engine speed during key-off conditions. Maintaining the engine ON at a lower threshold engine speed during key-off aids in maintaining PCV forward flow of intake gases (e.g., in the direction of dashed arrows 244) from the crankcase vent tube 274 through the crankcases 121 to the PCV line 276.

In some examples, the lower threshold engine speed may correspond to an idle engine speed. In another example, the lower threshold engine speed may correspond to an elevated idle engine speed (e.g., slightly greater than idle engine speed) in order to promote PCV forward flow of intake gases through the crankcase to aid in clean out of the crankcase. In one example, the lower threshold engine speed may include 600 rpm. In other examples, the lower threshold engine speed may be determined empirically and calibrated through data collection over a range of engine operating conditions and may depend on factors including, but not limited to, engine size, turbo size, drive cycle to drive cycle conditions, and the like. Furthermore, the controller 12 may send a message by way of instrument panel 196, indicating that the engine remaining ON at key-off is due to performing a temporary maintenance procedure. Next, method 700 continues at 740 where idle start/stop events are suppressed while the engine is maintained ON at the lower threshold engine speed in order to maintain PCV forward flow of intake gases and to discourage start/stop events which can reduce PCV forward flow and induce PCV backflow. At 740, controller 12 may further suppress boost conditions by maintaining an e-booster OFF and/or maintaining a supercharger OFF and a compressor 174 OFF.

Following 740, method 700 continues at 750 where controller 12 determines if a crankcase clean out condition is met. In one example, the crankcase clean out condition may be met when a PCV forward flow rate, $Q_{PCC,fwd}$, measured by CKCP sensor 177 and/or sensor 277, is greater than a threshold forward flow rate, $Q_{PCV,fwd,TH}$. CKCP sensor 177 and/or sensor 277 may measure the PCV forward flow rate by measuring one or more of a change in pressure, or by measuring a flow rate direction (e.g., when sensor 277 may be configured as a flow sensor). The threshold forward flow rate may correspond to a crankcase gas flow rate (e.g., a PCV forward flow rate) above which oil sludge clogging of the push-side oil separator 281 is cleaned out. In one example, the threshold forward flow rate may be 0; as such, when the PCV forward flow rate becomes measurably greater than 0, the crankcase clean out condition is met. In other examples, $Q_{PCV,fwd,TH}$ may be determined empirically and calibrated through data collection over a range of engine operating conditions and may depend on factors including, but not limited to, engine size, turbo size, drive cycle to drive cycle conditions, and the like.

For the case where the crankcase clean out condition is not met at 750, method 700 continues to 754 where the controller 12 determines if a crankcase clean out timeout condition has been met. The timeout condition may refer to a condition evaluated during the crankcase clean out that, when satisfied, indicates that clogging of the crankcase is severe and that the crankcase clean out is insufficient to dislodge and clear the clogged separator. In one example, the timeout condition may be met when a clean out duration, $\Delta t_{cleanout}$, is greater than a threshold clean out duration, $\Delta t_{cleanout,TH}$. $\Delta t_{cleanout}$ refers to a length of time since the engine is maintained ON at the lower threshold engine speed, while key-off conditions are met. $\Delta t_{cleanout,TH}$ may correspond to a threshold duration beyond which the crankcase clean out is unable to alleviate clogging of the push-side oil separator 281. In other examples, $\Delta t_{cleanout,TH}$ may be determined empirically and calibrated through data collection over a range of engine operating conditions and may depend on factors including, but not limited to, engine size, turbo size, drive cycle to drive cycle conditions, and the like.

$\Delta t_{cleanout}$ being greater than $\Delta t_{cleanout,TH}$ (while the crankcase clean out condition has not been met) may indicate that clogging of the push-side oil separator 281 may be too severe for the crankcase clean out. In another example, the timeout condition may be met when a rate of change in CKCP during the crankcase clean out is less than a lower threshold CKCP rate of change, $CKCP_{ROC,TH2}$. In one example, the threshold CKCP rate of change may be zero. In another example the timeout condition may be met when a rate of change in the PCV forward flow rate from the crankcase 121 to the crankcase vent tube 274 is less than a threshold PCV forward flow rate of change. In one example, the threshold rate of change in the PCV forward flow rate may be 0. In other examples, the lower threshold PCV forward flow rate of change may be determined empirically and calibrated through data collection over a range of engine operating conditions and may depend on factors including, but not limited to, engine size, turbo size, drive cycle to drive cycle conditions, and the like.

In one example, the timeout condition may be met when one of, two of, or all of $\Delta t_{cleanout}$ being greater than $\Delta t_{cleanout,TH}$, a rate of change in CKCP being less than the threshold CKCP rate of change, and a rate of change in the PCV forward flow rate being less than the threshold rate of change in the PCV forward flow rate is met. Responsive to the timeout condition being met, method 700 continues at 758 where the controller 12 may send a message to the vehicle operator to recommend maintenance service. Returning to 754 for the case when the timeout condition is not met, method 700 returns to 730 where the controller 12 maintains the engine ON at the lower threshold engine speed. Returning to 750, for the case where the crankcase clean out condition is met, method 700 continues to 760 where the controller 12 switches the engine OFF and resets $\Delta t_{cleanout}$ to 0. After 760, and after 758, method 700 returns to method 500 after 580.

In this manner, a method of operating an engine system including an engine comprises, measuring a crankcase pressure, and in response to the crankcase pressure increasing above a threshold pressure, determining a position of a clogged oil separator in a crankcase, and directing fluid to flow through the clogged oil separator and into the crankcase until a flow rate of the fluid through the clogged oil separator and into the crankcase increases above a threshold flow rate. In a first example, the method further comprises, wherein directing the fluid to flow through the clogged oil separator and into the crankcase includes directing the fluid to flow through the clogged oil separator and into the crankcase during a key-off condition. In a second example, optionally including the first example, the method further comprises, wherein determining the position of the clogged oil separator in the crankcase includes determining a clogged pull-side oil separator in response to a first condition being met, the first condition being met including when the crankcase pressure increases above the threshold pressure while the engine is operating in an unboosted state. In a third example, optionally including one or more of the first and second examples, the method further comprises, wherein directing fluid to flow through the clogged oil separator and into the crankcase during the key-off condition includes directing fluid to flow through the clogged oil separator and into the crankcase during the key-off condition responsive to determining the position of the clogged oil separator in the crankcase. In a fourth example, optionally including one or more of the first through third examples, the method further comprises, wherein determining the position of the clogged oil separator in the crankcase includes determining a clogged push-side oil separator in response to a second condition being met, the second condition being met including when the crankcase pressure increases above the threshold pressure while the engine is operating in a boosted state. In a fifth example, optionally including one or more of the first through fourth examples, the method further comprises, determining a cumulative boosted engine ON duration since performing a previous crankcase clean out, wherein the first condition being met further includes when the cumulative boosted engine ON duration is less than a threshold boosted duration. In a sixth example, optionally including one or more of the first through fifth examples, the method further comprises, determining a cumulative unboosted engine ON duration since performing the previous crankcase clean out, wherein the second condition being met further includes when the cumulative unboosted engine ON duration is less than a threshold unboosted duration. In a seventh example, optionally including one or more of the first through sixth examples, the method further comprises, determining a cumulative number of start-stop engine events since performing the previous crankcase clean out, wherein the second condition being met further includes when the cumulative number of start-stop engine events is greater than a threshold number of start-stop engine events.

In this manner, a method for an engine comprises, measuring a crankcase pressure, measuring a cumulative duration of boosted engine ON operation for the engine, measuring a cumulative duration of unboosted engine ON operation for the engine, and in response to the crankcase pressure increasing above a threshold pressure, determining a position of a clogged oil separator in a crankcase based on the cumulative duration of boosted engine ON operation and the cumulative duration of unboosted engine ON operation for the engine. In a first example, the method further comprises, wherein determining a position of a clogged oil separator in the crankcase based on the cumulative duration of boosted engine ON operation and the cumulative duration of unboosted engine ON operation for the engine includes indicating a clogged pull-side oil separator when the cumulative duration of boosted engine ON operation for the engine is less than a threshold boosted duration. In a second example, optionally including the first example, the method further comprises, wherein determining a position of a clogged oil separator in the crankcase based on the cumulative duration of boosted engine ON and the cumulative duration of unboosted engine ON operation for the engine includes indicating a clogged push-side oil separator when the cumulative duration of unboosted engine ON operation for the engine is less than a threshold unboosted duration. In a third example, optionally including one or more of the first and second examples, the method further comprises, in response to the crankcase pressure increasing above the threshold pressure, flowing fluid from an intake of the engine through the clogged oil separator into the crankcase.

Turning now to FIG. 8, it illustrates a timeline 800 for operating the engine 10 to diagnose a clogged crankcase and performing a crankcase clean out according to the methods of FIGS. 5-7. Trend lines are shown for CKCP 810, engine status 820, $\Delta t_{boost}$ 830, $\Delta t_{unboost}$ 840, key condition 850, number of start/stop events ($N_{ss}$) 860, throttle position 870, PCV valve position 876, e-booster status 878, PCV flow rate ($Q_{PCV}$) 880, clean out condition met status 890, clean out duration ($\Delta t_{cleanout}$) 894, and clean out frequency 888. Also shown are $P_{TH1}$ 812, lower threshold pressure ($P_{TH2}$) 814, $\Delta t_{boost,TH}$ 832, $\Delta t_{unboost,TH}$ 842, $N_{ss,TH}$ 862, $Q_{PCV,TH}$ 882, threshold clean out frequency 886, and a threshold clean out duration ($\Delta_{cleanout,TH}$) 892. In timeline 800, for purposes of illustration, $Q_{PCV}$ may generally represent PCV forward flow rate ($Q_{PCV,fwd}$) or PCV backflow flow rate ($Q_{PCV,back}$) (and $Q_{PCV,TH}$ may represent either $Q_{PCV,fwd,TH}$ or $Q_{PCV,back,TH}$), depending on whether the engine is being operated in boosted or unboosted conditions.

At time t0, the vehicle 5 is in operation and the key condition and engine status are both ON. Between time t0 and time t1, the engine status 820 shows primarily unboosted engine mode operation, with a couple of brief start/stop events occurring prior to time t1. As one example, the vehicle may be operating at predominantly low load engine conditions, such as coasting on a flat or slightly declining stretch of roadway. Thus, $\Delta t_{boost}$ remains below $\Delta t_{boost,TH}$ (and $N_{ss}$ remains below $N_{ss,TH}$), while $\Delta t_{unboost}$ steadily increases, rising beyond $\Delta t_{unboost,TH}$. During this period of operation, the throttle position and PCV valve position oscillate frequently, for delivery of sufficient intake air to the engine cylinders. The e-booster may be briefly cycled ON during the brief start/stop events, to reduce turbo lag and maintain vehicle responsiveness. The predominance of engine operation in unboosted mode between time t0 and t1 begins to clog the pull-side oil separator 280, causing CKCP to steadily increase, while $Q_{PCV}$ (here, corresponding to PCV forward flow) concurrently decreases.

At time t1, responsive to a CKCP condition being met, the controller 12 begins to diagnose and perform a clean out of the clogged crankcase. In the example of timeline 800, the CKCP condition being met includes when CKCP increasing beyond the threshold pressure, $P_{TH1}$. As previously discussed with reference to FIG. 4, in other examples, the CKCP condition being met may additionally or alternatively include when $CKCP_{ROC}>CKCP_{ROC,TH1}$. As the engine status was ON and operating in an unboosted state when CKCP increased above $P_{TH1}$, and because $\Delta t_{boost}<\Delta t_{boost,TH}$, the controller 12 determines that the pull-side oil separator may be clogged. Having diagnosed the clogged crankcase as being caused by a clogged pull-side oil separator, the controller 12 schedules a clean out of the crankcase to start at the next key-off condition. Between time t1 and time t2, the key condition remains ON, and the engine continues to operate in unboosted mode. As such, CKCP continues to increase steadily and $Q_{PCV}$ continues to decrease as the crankcase clog at the pull-side oil separator worsens.

At time t2, responsive to a key-off condition, the controller 12 begins the crankcase clean out, specifically targeting the pull-side oil separator (as described with reference to method 600 of FIG. 6), by shutting down the engine by way of a special valve sequence that precludes fluid communication between the engine intake and the engine exhaust (not shown in timeline 800). In the example of timeline 800, a dual clog (e.g., both oil separators clogged at the same time) is not present. Because the engine is OFF, and because the push-side oil separator is not clogged, a dual clog condition is not met and CKCP drops below a lower threshold pressure ($P_{TH2}$) 814. In one example, CKCP may decrease to atmospheric pressure as the crankcase gases are vented through the unclogged push-side oil separator. As shown in the timeline 800 at time t2, starting the crankcase clean out of the pull-side oil separator further includes, while the engine is OFF, opening the throttle (e.g., fully opening), opening the PCV valve (e.g., fully opening), and activating the engine boost conditions by turning ON the e-booster, to deliver boosted intake air from the PCV line 276 to the crankcase 121 (e.g., PCV backflow) in order to dislodge and clear clogging of oil sludge in the pull-side oil separator 280. Subsequent to the delivery of boosted PCV backflow gases to the crankcase after time t2, the PCV flow rate (e.g., $Q_{PCV,back}$) begins to increase as the oil sludge clogging the pull-side oil separator gradually becomes dislodged and cleared. Additionally, at time t2, controller 12 begins tracking a crankcase clean out duration 894, $\Delta t_{cleanout}$, responsive to the start of the crankcase clean out. Further still, with the start of a new crankcase clean out, a clean out frequency 888, as calculated by the controller 12, increases, but remains below a threshold clean out frequency 886.

At time t3, as a result of substantial clearing of the clogged pull-side oil separator 280, the PCV flow rate (e.g., $Q_{PCV,back}$) increases above $Q_{PCV,TH}$ (e.g., $Q_{PCV,back,TH}$), and in response to $Q_{PCV}>Q_{PCV,TH}$, the controller 12 ends the crankcase clean out since the crankcase clean out condition is met. Ending the crankcase clean out includes the controller 12 closing throttle 162, closing PCV valve 278, and deactivating the e-booster 250. Following the end of the crankcase clean out, the controller 12 also resets $\Delta t_{boost}$, $\Delta t_{unboost}$, and $N_{ss}$ to 0. Furthermore, since $\Delta t_{cleanout}<\Delta t_{cleanout,TH}$ (threshold clean out duration 892) at the end of the crankcase clean out, the clean out does not time out without clearing the clogged crankcase, and the controller 12 resets $\Delta t_{cleanout}$ to 0.

At time t4, the engine status and key condition are switched to ON. Between time t4 and time t5, the engine status 820 shows primarily boosted engine mode operation, with only a few brief unboosted periods of engine operation occurring prior to time t5. As one example, the vehicle may be operating at predominantly start/stop engine conditions, such as during stop and go traffic on city roads. Thus, $\Delta t_{unboost}$ remains below $\Delta t_{unboost,TH}$, while $\Delta t_{boost}$ and $N_{ss}$ steadily increase, rising beyond $\Delta t_{boost,TH}$ and $N_{ss,TH}$. During this period of operation, the throttle position and PCV valve position oscillate frequently, to deliver sufficient intake air to the engine cylinders. The e-booster is repeatedly cycled ON and OFF corresponding to the frequent start/stop events, to reduce turbo lag and maintain vehicle responsiveness. The predominance of engine operation in boosted mode between time t4 and t5 begins to clog the push-side oil separator 281, causing CKCP to steadily increase, while $Q_{PCV}$ (here, corresponding to PCV backflow) concurrently decreases.

At time t5, responsive to CKCP increasing beyond the threshold pressure, $P_{TH1}$, the controller 12 begins to diagnose and perform a clean out of the clogged crankcase. As the engine status was ON and operating in a boosted state when CKCP increased above $P_{TH1}$, and because $\Delta t_{unboost}<\Delta t_{unboost,TH}$, the controller 12 determines that the push-side oil separator 281 may be clogged. Having diagnosed the clogged crankcase as being caused by a clogged push-side oil separator, the controller 12 schedules a clean out of the crankcase to start at the next key-off condition. Between time t5 and time t6, the key condition remains ON, and the engine continues to operate in boosted mode. As such, CKCP continues to increase steadily and $Q_{PCV}$ continues to decrease as the crankcase clog at the push-side oil separator worsens.

At time t6, responsive to a key-off condition, the controller 12 begins the crankcase clean out, specifically targeting the push-side oil separator (as described with reference to method 700 of FIG. 7), by maintaining the engine ON at a lower threshold engine speed during key-off. In some examples, lower threshold engine speed can include an idling engine speed, or an elevated idling engine speed slightly higher than idling engine speed to promote PCV forward flow of gas to the crankcase 121. To maintain the engine ON at the lower threshold engine speed, the controller 12 may maintain throttle 162 at least partially open and maintain PCV valve at least partially open until the crankcase clean out condition is met. As shown in the timeline 800 at time t6, starting the crankcase clean out of the push-side oil separator further includes, while the engine is ON, suppressing start/stop events and suppressing boost conditions (as described with reference to 730 and 740 of method 700), in order to further aid in delivering naturally aspirated (e.g., unboosted) intake air from the intake passage 142 and crankcase vent tube 274 to the crankcase 121 (e.g., PCV forward flow) for dislodging and clearing clogging of oil sludge in the push-side oil separator 281. Subsequent to the delivery of unboosted PCV forward flow of gases to the crankcase after time t6, the PCV flow rate (e.g., $Q_{PCC,fwd}$) begins to increase as the oil sludge clogging the push-side oil separator gradually becomes dislodged and cleared.

Furthermore, responsive to maintaining the engine ON at the lower threshold idle speed, CKCP exhibits a step decrease at t6 followed by a steady decrease thereafter as the PCV forward flow begins to clear the push-side oil separator 281. Subsequent to the delivery of unboosted PCV forward flow gases to the crankcase after time t6, the PCV flow rate (e.g., $Q_{PCV,fwd}$) begins to increase as the oil sludge clogging the push-side oil separator 281 gradually becomes dislodged and cleared. Additionally, at time t6, controller 12 begins tracking a crankcase clean out duration 894, $\Delta t_{cleanout}$, responsive to the start of the crankcase clean out. Further still, with the start of a new crankcase clean out, clean out frequency 888, as calculated by the controller 12, increases, but remains below a threshold clean out frequency 886.

At time t7, as a result of substantial clearing of the clogged push-side oil separator 281, the PCV flow rate (e.g., $Q_{PCV,fwd}$) increases above $Q_{PCV,TH}$ (e.g., $Q_{PCV,fwd,TH}$), and in response to $Q_{PCV}>Q_{PCV,TH}$, the controller 12 ends the crankcase clean out since the crankcase clean out condition is met. Ending the crankcase clean out includes the controller 12 switching the engine OFF. Following the end of the crankcase clean out, the controller 12 also resets $\Delta t_{boost}$, $\Delta t_{unboost}$, and $N_{ss}$ to 0. Furthermore, since $\Delta t_{cleanout}<\Delta t_{cleanout,TH}$ (threshold clean out duration 892) at the end of the crankcase clean out, the clean out does not time out without clearing the clogged crankcase, and the controller 12 resets $\Delta t_{cleanout}$ to 0.

In this manner, an engine system comprises, an engine including a positive crankcase ventilation (PCV) system, the PCV system including a crankcase, a pressure sensor positioned at the crankcase, and a PCV valve, and a controller, including executable instructions residing in non-transitory memory thereon to, measure a crankcase pressure with the pressure sensor, and in response to the crankcase pressure increasing above a threshold pressure, indicating a clogged oil separator in the crankcase, and during a key-off condition, flowing fluid through the clogged oil separator into the crankcase. In a first example, the system further comprises, wherein the executable instructions to flow fluid through the clogged oil separator into the crankcase includes flowing the fluid through the clogged oil separator into the crankcase until a crankcase clean out condition is met, the crankcase clean out condition being met including when a flow rate of the fluid through the clogged oil separator increases above a threshold flow rate. In a second example, optionally including the first example, the system further comprises, wherein the executable instructions to indicate the clogged oil separator in the crankcase include indicating a clogged pull-side oil separator during a first condition, the first condition including when the crankcase pressure increases above the threshold pressure while the engine is operating in an unboosted state. In a third example, optionally including one or more of the first and second examples, the system further comprises, wherein the executable instructions to indicate the clogged oil separator in the crankcase include indicating a clogged push-side oil separator during a second condition, the second condition including when the crankcase pressure increases above the threshold pressure while the engine is operating in a boosted state. In a fourth example, optionally including one or more of the first through third examples, the system further comprises, wherein the executable instructions further include, in response to the first condition being met, during the key-off condition, opening a throttle of the engine and opening the PCV valve. In a fifth example, optionally including one or more of the first through fourth examples, the system further comprises an e-booster, wherein the executable instructions further include, in response to the first condition being met, during the key-off condition, activating the e-booster. In a sixth example, optionally including one or more of the first through fifth examples, the system further comprises, wherein the executable instructions further include, in response to the second condition being met, during the key-off condition, maintaining the engine ON at an idle engine speed. In a seventh example, optionally including one or more of the first through sixth examples, the system further comprises, wherein the executable instructions further include, in response to the first condition being met, during the key-off condition, shutting down the engine, wherein shutting down the engine includes operating cylinder valves of the engine to preclude fluid communication between an engine intake and an engine exhaust.

In this way, the technical effect of automatically diagnosing and self-cleaning a clogged PCV system onboard a vehicle is provided. Furthermore, by mitigating blockages in the PCV system, a risk of vehicle operation with increased internal engine pressures can be reduced, thereby increasing vehicle performance. Further still, maintenance service on the vehicle can be reduced, thereby increasing customer satisfaction and reducing vehicle downtime.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating an engine system including an engine, comprising:

measuring a crankcase pressure, and in response to the crankcase pressure increasing above a threshold pressure, determining a position of a clogged oil separator in a crankcase, and directing fluid to flow through the clogged oil separator and into the crankcase until a flow rate of the fluid through the clogged oil separator and into the crankcase increases above a threshold flow rate.

2. The method of claim 1, wherein directing the fluid to flow through the clogged oil separator and into the crankcase includes directing the fluid to flow through the clogged oil separator and into the crankcase during a key-off condition.

3. The method of claim 2, wherein directing fluid to flow through the clogged oil separator and into the crankcase during the key-off condition includes directing fluid to flow through the clogged oil separator and into the crankcase during the key-off condition responsive to determining the position of the clogged oil separator in the crankcase.

4. The method of claim 1, wherein determining the position of the clogged oil separator in the crankcase includes determining a clogged pull-side oil separator in response to a first condition being met, the first condition being met including when the crankcase pressure increases above the threshold pressure while the engine is operating in an unboosted state.

5. The method of claim 4, wherein determining the position of the clogged oil separator in the crankcase includes determining a clogged push-side oil separator in response to a second condition being met, the second condition being met including when the crankcase pressure increases above the threshold pressure while the engine is operating in a boosted state.

6. The method of claim 5, further comprising determining a cumulative boosted engine ON duration since performing a previous crankcase clean out, wherein the first condition being met further includes when the cumulative boosted engine ON duration is less than a threshold boosted duration.

7. The method of claim 6, further comprising determining a cumulative unboosted engine ON duration since performing the previous crankcase clean out, wherein the second condition being met further includes when the cumulative unboosted engine ON duration is less than a threshold unboosted duration.

8. The method of claim 7, further comprising determining a cumulative number of start-stop engine events since performing the previous crankcase clean out, wherein the second condition being met further includes when the cumulative number of start-stop engine events is greater than a threshold number of start-stop engine events.

9. An engine system, comprising:

an engine including a positive crankcase ventilation (PCV) system, the PCV system including a crankcase, a pressure sensor positioned at the crankcase, and a PCV valve, and a controller, including executable instructions residing in non-transitory memory thereon to, measure a crankcase pressure with the pressure sensor, and in response to the crankcase pressure increasing above a threshold pressure, indicating a clogged oil separator in the crankcase, and during a key-off condition, flowing fluid through the clogged oil separator into the crankcase.

10. The engine system of claim 9, wherein the executable instructions to flow fluid through the clogged oil separator into the crankcase includes flowing the fluid through the clogged oil separator into the crankcase until a crankcase clean out condition is met, the crankcase clean out condition being met including when a flow rate of the fluid through the clogged oil separator increases above a threshold flow rate.

11. The engine system of claim 10, wherein the executable instructions to indicate the clogged oil separator in the crankcase include indicating a clogged pull-side oil separator during a first condition, the first condition including when the crankcase pressure increases above the threshold pressure while the engine is operating in an unboosted state.

12. The engine system of claim 11, wherein the executable instructions to indicate the clogged oil separator in the crankcase include indicating a clogged push-side oil separator during a second condition, the second condition including when the crankcase pressure increases above the threshold pressure while the engine is operating in a boosted state.

13. The engine system of claim 12, wherein the executable instructions further include, in response to the first condition being met, during the key-off condition, opening a throttle of the engine and opening the PCV valve.

14. The engine system of claim 13, further including an e-booster, wherein the executable instructions further include, in response to the first condition being met, during the key-off condition, activating the e-booster.

15. The engine system of claim 14, wherein the executable instructions further include, in response to the second condition being met, during the key-off condition, maintaining the engine ON at an idle engine speed.

16. The engine system of claim 15, wherein the executable instructions further include, in response to the first condition being met, during the key-off condition, shutting down the engine, wherein shutting down the engine includes operating cylinder valves of the engine to preclude fluid communication between an engine intake and an engine exhaust.

17. A method for an engine, comprising:

measuring a crankcase pressure, measuring a cumulative duration of boosted engine ON operation for the engine, measuring a cumulative duration of unboosted engine ON operation for the engine, and in response to the crankcase pressure increasing above a threshold pressure, determining a position of a clog within multiple oil separators in a crankcase based on the cumulative duration of boosted engine ON operation and the cumulative duration of unboosted engine ON operation for the engine.

18. The method of claim 17, wherein determining a position of a clog includes indicating a clogged pull-side oil separator when the cumulative duration of boosted engine ON operation for the engine is less than a threshold boosted duration.

19. The method of claim 17, wherein determining a position of a clog includes indicating a clogged push-side oil separator when the cumulative duration of unboosted engine ON operation for the engine is less than a threshold unboosted duration.

20. The method of claim 17, further comprising, in response to the crankcase pressure increasing above the threshold pressure, flowing fluid from an intake of the engine through the clogged oil separator into the crankcase.

* * * * *